US008327676B2

(12) United States Patent
Nishimori et al.

(10) Patent No.: US 8,327,676 B2
(45) Date of Patent: Dec. 11, 2012

(54) UPPER-END FORMED GLASS COMPLEX FOR HOT EXPANDING PIERCING AND METHOD OF MANUFACTURING BILLET FOR HOT EXTRUSION PIPE MAKING

(75) Inventors: Junichi Nishimori, Osaka (JP); Tomio Yamakawa, Osaka (JP); Keishi Matsumoto, Osaka (JP); Hiroaki Murakami, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 13/116,272

(22) Filed: May 26, 2011

(65) Prior Publication Data

US 2011/0219837 A1 Sep. 15, 2011

Related U.S. Application Data

(63) Continuation of application No. PCT/JP2009/068459, filed on Oct. 28, 2009.

(30) Foreign Application Priority Data

Dec. 1, 2008 (JP) ..... 2008-306739

(51) Int. Cl.
*B21B 45/02* (2006.01)

(52) U.S. Cl. ..... 72/41; 72/97

(58) Field of Classification Search ..... 72/41, 42, 72/97, 208, 209, 253.1, 264, 265
See application file for complete search history.

(56) References Cited

U.S. PATENT DOCUMENTS

| | | | | | |
|---|---|---|---|---|---|
| 1,675,910 | A | * | 7/1928 | Riker | 72/325 |
| 2,346,376 | A | * | 4/1944 | Heavener | 72/68 |
| 2,538,917 | A | * | 1/1951 | Sejournet et al. | 72/42 |
| 2,756,494 | A | * | 7/1956 | Jacques | 72/42 |
| 2,791,924 | A | * | 5/1957 | Sawyer | 72/42 |
| 3,335,589 | A | * | 8/1967 | Buffet | 72/41 |
| 3,397,560 | A | * | 8/1968 | Kaprelian | 72/41 |
| 3,423,975 | A | * | 1/1969 | Collinet | 72/42 |
| 3,633,396 | A | * | 1/1972 | Eriksson | 72/41 |
| 3,712,103 | A | * | 1/1973 | Malegue | 72/264 |
| 6,016,681 | A | * | 1/2000 | Kenning | 72/393 |

FOREIGN PATENT DOCUMENTS

| | | | |
|---|---|---|---|
| JP | 06-106232 | * | 4/1984 |
| JP | 02-055615 | * | 2/1990 |
| JP | 06-170437 | * | 6/1994 |
| JP | 59-179214 | * | 10/1994 |
| JP | 2005-00927 | | 1/2005 |
| JP | 2005-059069 | | 3/2005 |
| JP | 2007-229771 | | 9/2007 |

* cited by examiner

*Primary Examiner* — Dana Ross
*Assistant Examiner* — Homer Boyer
(74) *Attorney, Agent, or Firm* — Clark & Brody

(57) ABSTRACT

When a hollow billet is inserted into a container, and hot expanding piercing is downwardly performed by using a plug, hot piercing is performed by using a formed glass complex comprising a ring-shaped formed glass part and a ring-shaped projecting part. The ring-shaped formed glass part assumes a disc shape having a circular opening for allowing a plug to be inserted at the center thereof. The ring-shaped projecting part is attached to the opening of the ring-shaped formed glass part, and assumes a ring shape projecting perpendicularly to the ring-shaped formed glass part. Thereby, the piercing work can be done safely, and defects can be prevented from occurring on the inner surface of the billet.

6 Claims, 3 Drawing Sheets

UPPER-END FORMED GLASS COMPLEX FOR HOT EXPANDING PIERCING AND METHOD OF MANUFACTURING BILLET FOR HOT EXTRUSION PIPE MAKING

TECHNICAL FIELD

The present invention relates to an upper-end formed glass complex for hot expanding piercing used as an upper-end lubricant for a hollow billet (especially, a hollow billet made of hard-to-work material), which is used as a starting material in the Ugine-Sejournet pipe-making process, when the hollow billet is subjected to hot expanding piercing. Also, the present invention relates to a method of manufacturing a billet for hot extrusion pipe making, the method using the above-described formed glass complex.

Unless otherwise stated, the definitions of terms in this description are as follows:

"Hollow billet": A billet used for hot expanding piercing (hereinafter also referred to simply as "hot piercing"), the billet being fabricated into a hollow shape with a guide hole by machining in advance. Hereinafter, it is also referred to simply as a "billet".

"Billet for hot extrusion pipe making": A billet used for hot extrusion pipe making, which has been already subjected to hot expanding piercing. Hereinafter, it is also referred to simply as a "billet for pipe making".

"Upper-end lubricant": A lubricant used at the time of hot expanding piercing of a hollow billet in a state of being placed on the upper end of the hollow billet.

BACKGROUND ART

In the Ugine-Sejournet pipe-making process, glass is used as a lubricant for hot extrusion. This Ugine-Sejournet pipe-making process is excellent in workability in pipe making, and therefore a billet can be processed at a relatively high reduction rate by this pipe-making process. Therefore, the Ugine-Sejournet pipe-making process has been used frequently in manufacturing a seamless pipe made of a hard-to-work material such as a high alloy as the source material.

A hollow billet is used as a starting material for a hot extruded pipe to be manufactured by the Ugine-Sejournet pipe-making process, and a guide hole is formed in this hollow billet in advance by machining. At the time of hot pipe making, a mandrel of an extrusion press is inserted into this guide hole.

In the case where a large-diameter mandrel is used to extrude the hollow billet for making a pipe, a pilot hole must be drilled (machined) for the billet according to the mandrel diameter. The processing of the pilot hole significantly decreases the operation efficiency, and also aggravates the yield loss. Usually, in the Ugine-Sejournet pipe-making process, the billet for pipe making to be fed to the extrusion press is subjected to hot expanding piercing as preliminary working.

FIG. 1 is an explanatory view for explaining a hot expanding piercing step performed as preliminary working of the billet for pipe making. FIG. 1A shows a state in which the hollow billet is put in place in a container. FIG. 1B shows a process in which the hollow billet is being expansion-pierced. FIG. 1C shows the hollow billet after expansion-piercing.

As shown in FIG. 1A, a hollow billet 1 with a guide hole 1*a* drilled therein is inserted into a container 2 in such a manner that the bottom part of billet is in contact with the inner surface of the back end of the container 2. The hollow billet 1 is heated to about 1100 to 1200° C. before being inserted into the container 2.

Successively, as shown in FIGS. 1B and 1C, the hollow billet 1 is expansion-pierced and the inside diameter thereof is expanded by using a mandrel 4 provided with a plug 3, which is used for expansion and has a predetermined diameter, at the front end thereof. The hollow billet 1 having been expansion-pierced (this hollow billet 1 is used as a billet 1 for pipe making) is pushed upward by an ejector from the bottom and is taken out of the container 2. Subsequently, the billet 1 for pipe making is reheated and fed to the extrusion press used in the Ugine-Sejournet pipe-making process.

In the hot expanding piercing step shown in FIG. 1, in the case where the hollow billet is made of a hard-to-work material, defects such as tool seizing and scratches caused by poor lubrication are very likely to occur on the outer surface and/or the inner surface of the hot pierced billet. Such a hard-to-work material may include: a high alloy of high Cr and high Ni, where containing alloying elements in large amounts; an alloy steel containing Ti; and the like.

As the prior art for preventing the defect caused by poor lubrication from occurring, the methods described below have been disclosed.

Non Patent Literature 1 describes a method in which glass is used as a lubricant in the Ugine-Sejournet pipe-making process. For example, glass powder and/or a lump-like glass powder is supplied, as a lubricant, to the beveled part on the billet upper end and the inner hole (guide hole) of the billet.

Patent Literatures 1, 2 and 3 describe a method in which a glass lubricant is coated onto the outer surface and the inner surface of the billet in the hot expanding piercing of the hollow billet used in the Ugine-Sejournet pipe-making process. As a workpiece, high-alloy Hastelloy C276 is processed in Patent Literature 1, a high-nickel alloy is processed in Patent Literature 2, and a SUS304 material is processed in Patent Literature 3.

Concerning the specific shape of glass lubricant, for example, FIG. 1B of Patent Literature 1 shows a ball-shaped glass lubricant. This ball-shaped glass lubricant is placed in the beveled part on the upper end of the hollow billet. Also, FIG. 4A of Patent Literature 1 shows a glass lubricant (formed glass) formed into a ring shape. This ring-shaped glass lubricant is placed on the upper end of the hollow billet 1. The formed glass is the one formed by solidifying glass powder with a binder such as silicate soda In the hot piercing of the hard-to-work material, sufficient lubrication cannot be provided by merely coating glass powder or placing the lump-like glass in the beveled part on the upper end of the hollow billet. In particular, the inner surface of the hollow billet cannot be sufficiently lubricated. In some cases, therefore, there is used a method in which the formed glass of a ring shape is placed on the upper end of the hollow billet (example: the formed glass shown in FIG. 4A of Patent Literature 1).

However, in the case where the ring-shaped formed glass is merely placed on the billet, the glass is dislocated or scattered by vibrations etc during expansion-piercing, and/or by the change of position of the plug. Therefore, the lubrication may become insufficient, and eccentric wall happens to occur in the billet after expansion-piercing.

Conventionally, at the time of hot expanding piercing, a metallic ring has been mounted around the ring-shaped formed glass on the billet upper end (refer to FIG. 2B described later). By the mounting of this metallic ring, the glass can be prevented from dislocation (misfit) or scattering.

However, the method in which the metallic ring is mounted around the ring-shaped formed glass has the following problems:

(1) Mounting the metallic ring before hot expanding piercing and demounting it after the completion of expansion-piercing are performed in a high-temperature environment. Therefore, it is difficult to ensure the worker's safety.

(2) The inner surface of the hollow billet cannot be sufficiently lubricated by merely placing the glass lubricant on the upper end of the hollow billet. Therefore, defects may occur on the inner surface of the billet after hot expanding piercing.

CITATION LIST

Patent Literature

Patent Literature 1: Japanese Patent Application Publication No. 2005-927

Patent Literature 2: Japanese Patent Application Publication No. 2005-59069

Patent Literature 3: Japanese Patent Application Publication No. 2007-229771

Non Patent Literature

Non Patent Literature 1: Edited by The Iron and Steel Institute of Japan, "Iron and Steel Handbook, Third edition, Vol. 3, Bar Steel, Steel Pipe, and Rolling Equipment", pp. 1020-1021, published by Maruzen Co., Ltd., Jan. 20, 1982

SUMMARY OF INVENTION

Technical Problem

An objective of the present invention is to provide an upper-end formed glass complex for hot expanding piercing capable of meeting the following requirements (1) and (2) when a hollow billet is subjected to hot expanding piercing.

(1) The worker's safety can be ensured.

(2) Defects (scratch flaw, seizure flaw, etc.) occurring on the inner surface of a billet for pipe making can be prevented.

Another objective of the present invention is to provide a method of manufacturing a billet for hot extrusion pipe making, the method using the formed glass of the present invention.

Solution to Problem

The gist of the present invention is as follows:

(I) An upper-end formed glass complex for hot expanding piercing, which is used as an upper-end lubricant for a hollow billet when the hollow billet inserted in a container is subjected to hot expanding piercing using a plug, wherein the formed glass complex comprises a ring-shaped formed glass part and a ring-shaped projecting part;

the ring-shaped formed glass part assumes a disc shape having a circular opening for allowing a plug to be inserted at the center thereof; and the ring-shaped projecting part is attached to the opening of the ring-shaped formed glass part, and assumes a ring shape projecting perpendicularly to the ring-shaped formed glass part.

The formed glass complex of the present invention preferably has a shape described below. This embodiment is referred to as a "first embodiment".

In the upper-end formed glass complex for hot expanding piercing described in the above-described item (I), the thickness of the ring of the ring-shaped projecting part is 5 to 20 mm, the outside diameter of the ring-shaped projecting part is 1 to 10 mm smaller than the inside diameter of the hollow billet, the projection length in a height-wise direction of the ring-shaped projecting part is 5 to 20 mm, and the height of the ring-shaped formed glass part from the billet upper end is 10 to 35 mm.

The formed glass complex of the present invention preferably has the above-described shape and further meets the conditions described below. This embodiment is referred to as a "second embodiment".

The upper side of the opening of the ring-shaped formed glass part is beveled; and the bevel angle is 10 to 20° relative to the vertical line.

(II) A method of manufacturing a billet for hot extrusion pipe making, wherein when a hollow billet is inserted into a container, and hot expanding piercing is downwardly performed by using a plug, the above-described upper-end formed glass complex for hot piercing of the present invention (including the first and second embodiments) is used as an upper-end lubricant for the hollow billet.

Advantageous Effects of Invention

The upper-end formed glass complex for hot piercing of the present invention achieves the following remarkable effects:

(1) When the hollow billet is subjected to hot expanding piercing, the worker's safety can be ensured.

(2) Defects (scratch flaw, seizure flaw, etc.) can be prevented from occurring on the inner surface of a billet for pipe making.

According to the method of manufacturing a billet for hot extrusion pipe making of the present invention, when the hollow billet is subjected to hot expanding piercing, the worker's safety can be ensured. Also, a billet for pipe making having a very small number of inner surface defects (scratch flaws, seizure flaws, etc.) can be manufactured.

DESCRIPTION OF EMBODIMENTS

An upper-end formed glass complex for hot piercing in accordance with the present invention will now be described with reference to the accompanying drawings.

FIG. 2 is longitudinal sectional views for schematically showing the shapes of the upper-end formed glass lubricants.

Figure 1A:
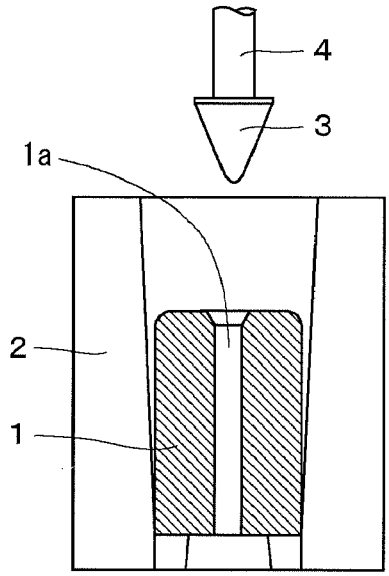
FIG. 1 is explanatory views for explaining a processing step of hot expanding piercing performed as preliminary working of a billet for pipe making, FIG. 1A showing a state in which a hollow billet is inserted in a container, FIG. 1B showing a process in which the hollow billet is being pierced, and FIG. 1C showing the hollow billet having been pierced.
Figure 1B:
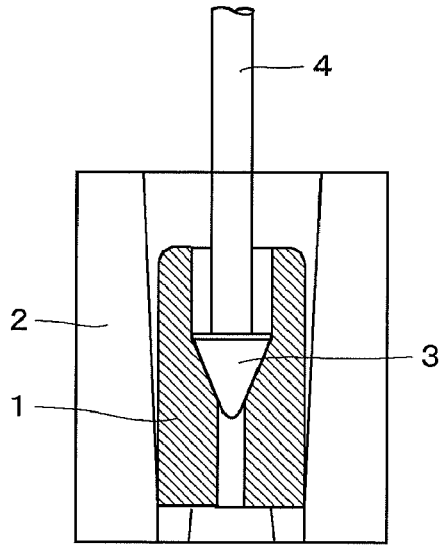
Figure 1C:
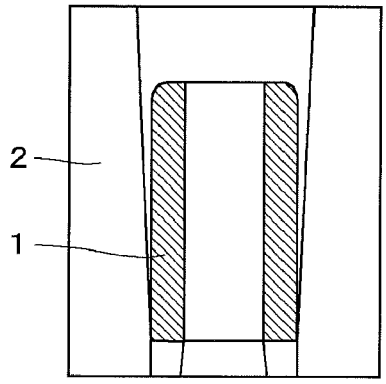
Figure 2A:
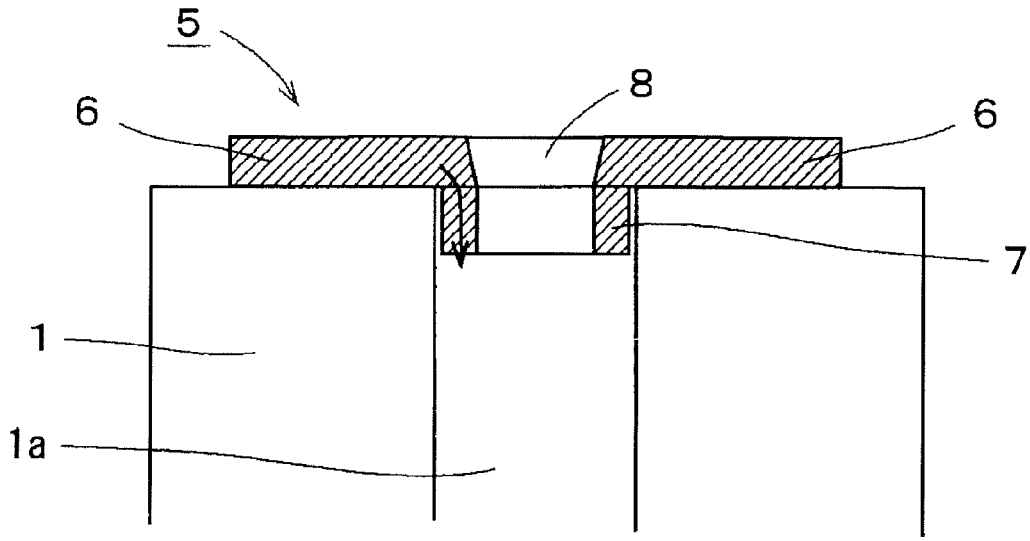
FIG. 2 is longitudinal sectional views for schematically showing the shapes of upper-end formed glass lubricants, FIG. 2A showing the upper-end formed glass complex of the present invention, and FIG. 2B showing a conventional upper-end formed glass.
Figure 2B:
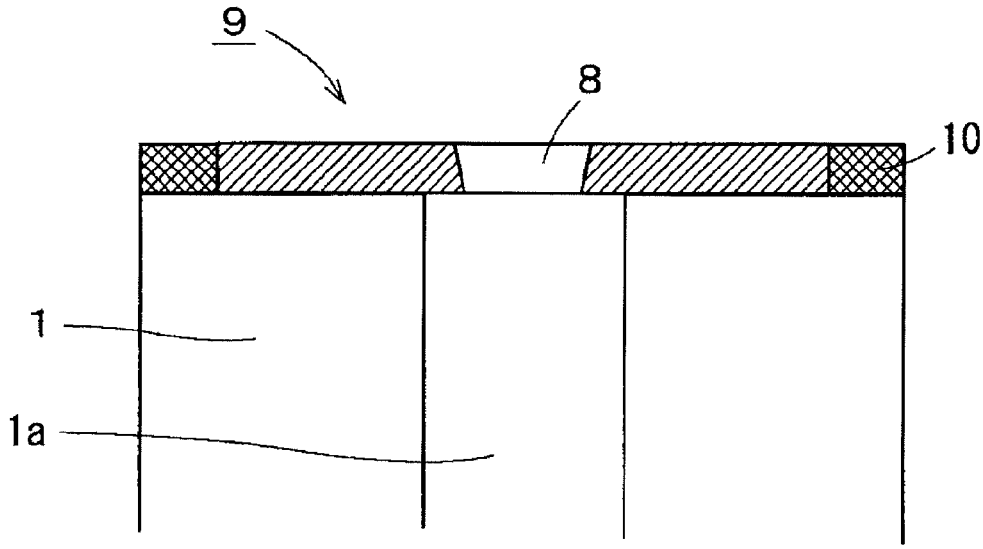

FIG. 2A shows the upper-end formed glass complex of the present invention, and FIG. 2B shows a conventional upper-end formed glass.

As shown in FIG. 2A, an upper-end formed glass complex 5 in accordance with the present invention comprises a ring-shaped formed glass part 6 and a ring-shaped projecting part 7. The ring-shaped formed glass part 6 assumes a disc shape having a circular opening 8 for allowing a plug (not shown) to be inserted at the center thereof. The ring-shaped projecting part 7 is attached to the opening 8 of the ring-shaped formed glass part 6, and assumes a ring shape projecting perpendicularly to the ring-shaped formed glass part 6.

FIG. 2A shows the state in which the upper-end formed glass 5 complex is placed on the upper end of a hollow billet 1. The ring-shaped projecting part 7 is inserted in the hollow portion (a guide hole 1*a*) of the hollow billet 1.

As shown in FIG. 2B, a conventional ring-shaped formed glass 9 comprises only a ring-shaped flat plate having the opening 8 at the center thereof. When the conventional ring-shaped formed glass 9 is used, a metallic ring 10 is attached to the outer periphery of the formed glass 9. The metallic ring 10 is attached to prevent the glass from being dislocated by vibrations during piercing, the change of position of plug, or the like.

One reason why the upper-end formed glass complex of the present invention assumes the shape shown in FIG. 2A is to ensure the worker's safety in hot expanding piercing the hollow billet.

The upper-end formed glass complex of the present invention has the ring-shaped projecting part, and this projecting part is inserted in the guide hole of the hollow billet. In other words, the upper-end formed glass complex is restrained by the guide hole of the hollow billet. Therefore, even if the vibrations during piercing, the change of position of plug, or the like occurs, the upper-end formed glass complex can be prevented from dislocation. As a result, the metallic ring becomes unnecessary. Therefore, the worker is freed from operations for mounting and demounting the metallic ring to be performed in a high-temperature environment in which the safety is difficult to be ensured.

When the upper-end formed glass complex of the present invention is placed on the upper end of the hollow billet, the ring-shaped projecting part has only to be inserted into the guide hole. Thereby, the center axis of the upper-end formed glass complex can readily coincide with the center axis of the guide hole of the hollow billet. That is, the ring-shaped projecting part also functions as a guide. As a result, the work for placing the upper-end formed glass complex on the upper surface of the hollow billet can be performed smoothly and safely.

Another reason why the upper-end formed glass complex of the present invention assumes the shape shown in FIG. 2A is to prevent defects (scratch flaw, seizure flaw, etc.) from occurring on the inner surface of a billet for pipe making.

As shown in FIG. 2A, the ring-shaped projecting part included in the upper-end formed glass complex of the present invention is inserted in the guide hole 1*a* of the hollow billet 1. Since the hollow billet 1 has been heated, the ring-shaped projecting part 7 becomes sticky (molten state). The molten glass thus produced contributes to the lubrication between the inner wall surface of the guide hole 1*a* and the plug. Further, as indicated by an arrow mark in FIG. 2A, glass is also supplied from the ring-shaped formed glass part 6. Thus, the amount of lubricant (lubrication amount) necessary for the lubrication between the inner wall surface of the guide hole 1*a* and the plug is secured. As a result, defects are prevented from occurring on the inner surface of the billet for pipe making.

The formed glass complex of a first embodiment of the present invention meets the conditions (a) to (d) described below. Also, the formed glass complex of a second embodiment of the present invention meets the conditions (a) to (d) described below and further meets the conditions (e) and (f) described below.

(a) The ring of the ring-shaped projecting part has a thickness of 5 to 20 mm.

(b) The outside diameter of the ring-shaped projecting part is smaller than the inside diameter of the hollow billet by 1 to 10 mm.

(c) The projection length in a height-wise direction of the ring-shaped projecting part is 5 to 20 mm.

(d) The height of the ring-shaped formed glass part from the billet upper end is 10 to 35 mm.

(e) The upper side of the opening of the ring-shaped formed glass part is beveled.

(f) The bevel angle is 10 to 20° relative to the vertical line.

Figure 3:
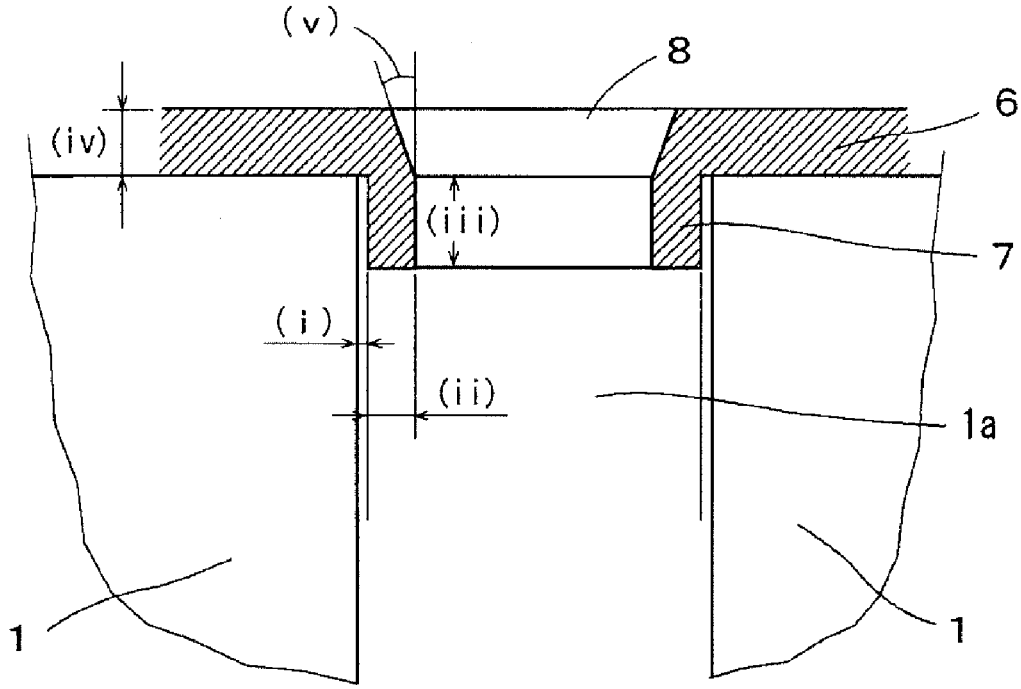
FIG. 3 is an explanatory view for explaining formed glass complex of first and second embodiments of the present invention.

FIG. 3 is an explanatory view for explaining the formed glass complex of first and second embodiments. In FIG. 3, symbol (i) denotes a gap (distance) between the ring-shaped projecting part 7 and the inner wall of the hollow billet 1. Symbol (ii) denotes the thickness of the ring of the ring-shaped projecting part 7. Symbol (iii) denotes the projection length in a height direction of the ring-shaped projecting part 7. Symbol (iv) denotes the height of the ring-shaped formed glass part 6 from the billet upper end (that is, the thickness of the ring-shaped formed glass part 6). Symbol (v) denotes the angle of the upper side (beveled part) of the opening of the ring-shaped formed glass part.

The reasons why the formed glass complex of the first embodiment needs to meet the conditions (a) to (d) are as follows:

(a) Thickness of Ring of Ring-Shaped Projecting Part

It is desirable to specify the thickness of the ring of the ring-shaped projecting part (symbol (ii) in FIG. 3) to be 5 to 20 mm. If the thickness of the ring is less than 5 mm, the supply amount of lubricant is small, so that the lubricity is impaired. Further, the melting of the ring-shaped projecting part proceeds quickly, so that the formed glass is dislocated (shifted) easily by the vibrations etc during piercing. If the thickness of the ring is more than 20 mm, the supply amount of lubricant is too large, so that the surface properties of the inner surface skin deteriorate. That is, by keeping the thickness of the ring of the ring-shaped projecting part in the above-described range, the lubricity between the hollow billet and the plug is maintained, and thereby the formed glass complex can be effectively prevented from dislocation.

(b) Difference Between Outside Diameter of Ring-Shaped Projecting Part and Inside Diameter of Hollow Billet It is desirable that the outside diameter of the ring-shaped projecting part be smaller than the inside diameter of the hollow billet by 1 to 10 mm. In other words, it is desirable to specify the difference between the outside diameter of the ring-shaped projecting part and the inside diameter of the hollow billet (for example, symbol (i) shown in FIG. 3) to be 1 to 10 mm. If the gap between the ring-shaped projecting part 7 and the inner wall of the hollow billet 1 is less than 1 mm, it is difficult to insert the ring-shaped projecting part 7 into the guide hole 1*a*. If the gap between the ring-shaped projecting part 7 and the inner wall of the hollow billet 1 is more than 10 mm, the dislocation occurs easily between the center axis of the hollow billet and the center axis of the upper-end formed glass complex. As a result, uniform lubrication is not provided on the billet inner surface, so that a trouble such as eccentric wall thickness occurs easily.

(c) Projection Length in a Height-Wise Direction of Ring-Shaped Projecting Part

It is desirable to specify the projection length in a height-wise direction of the ring-shaped projecting part (symbol (iii) in FIG. 3) to be 5 to 20 mm. If the length is less than 5 mm, the supply amount of lubricant is small, so that the lubricity is impaired. In the case where the length is extremely short, the formed glass complex is dislocated (shifted) easily by the vibrations etc during piercing. If the length is more than 20 mm, the supply amount of lubricant is too large, so that the surface properties of the inner surface skin deteriorate. That is, by keeping the length in a height-wise direction of the ring-shaped projecting part in the above-described range, the lubricity between the hollow billet and the plug is maintained, and thereby the formed glass complex can be effectively prevented from dislocation.

(d) Height (Thickness) of Ring-Shaped Formed Glass Part from Billet Upper End

It is desirable to specify the thickness of the ring-shaped formed glass part (symbol (iv) in FIG. 3) to be 10 to 35 mm. If the thickness of the ring-shaped formed glass part is less than 10 mm, the lubricity is easily impaired. This is because the amount of glass supplied from the ring-shaped formed glass part 6 (the arrow mark in FIG. 2A shows the flow of glass) decreases. If the thickness is more than 35 mm, the piercing force increases. Also, more lubricant is introduced into the guide hole unnecessarily, so that unit cost of glass increases.

The reasons why the formed glass complex of the second embodiment needs to meet the conditions (e) and (f), other than meeting the conditions (a) to (d), are as follows:

(e) Beveling of Upper (Entry) Side of Opening of Ring-Shaped Formed Glass Part

It is desirable to bevel the upper side of the opening of the ring-shaped formed glass part. This is because the formed glass part is likely broken by the impact at the time when the plug comes into contact with the upper side of the opening of the ring-shaped formed glass part, and accordingly the ring-shaped projecting part may drop.

(f) Bevel Angle on Upper Side of Opening of Ring-Shaped Formed Glass Part

It is desirable to specify the bevel angle (symbol (v) in FIG. 3) on the upper side of the opening of the ring-shaped formed glass part to be 10 to 20°. If the bevel angle deviates from this range, the ring-shaped projecting part is very likely to drop due to the contact of the plug with the ring-shaped formed glass part.

While being taken for granted in view of the purpose of lubrication, the outside diameter of the upper-end formed glass complex of the present invention (that is, the outside diameter of the ring-shaped formed glass part) is made larger than the diameter of the plug used for hot piercing. This is because the plug and the workpiece (hollow billet) are prevented from being brought into direct contact with each other.

If the above-described upper-end formed glass complex for hot piercing of the present invention is used when the hollow billet is subjected to hot expanding piercing, the following remarkable effects are achieved:

(1) Since the metallic ring is unnecessary, the worker's safety can be ensured.

(2) Since the amount of lubricant (lubrication amount) necessary for lubrication between the inner wall surface of guide hole and the plug is secured, defects (scratch flaw, seizure flaw, etc.) can be prevented from occurring on the inner surface of the billet for pipe making.

A method of manufacturing a billet for hot extrusion pipe making of the present invention is the one in which when the hollow billet is inserted into a container, and hot expanding piercing is downwardly performed by using the plug, the above-described upper-end formed glass complex for hot piercing of the present invention (including the first and second embodiments) is used as an upper-end lubricant for the hollow billet.

By using the upper-end formed glass complex for hot piercing of the present invention (including the first and second embodiments), the metallic ring becomes unnecessary as described above. Further, the upper-end formed glass complex can be placed on the upper end of the hollow billet smoothly and safely. As a result, when the hollow billet is subjected to hot expanding piercing, the worker's safety can be ensured.

Also, by using the upper-end formed glass complex for hot piercing of the present invention (including the first and second embodiments), the ring-shaped projecting part is placed in a sticky (molten) state as described above, so that a lubricating function is accomplished. Further, glass is also supplied from the ring-shaped formed glass part. As a result, the amount of lubricant (lubrication amount) necessary for lubrication between the inner wall surface of guide hole and the plug is secured, and therefore defects can be prevented from occurring on the inner surface of the billet for pipe making.

By using the upper-end formed glass complex for hot piercing of the present invention (including the first and second embodiments), an effect of reducing punched discard metal is also achieved. This is because due to the increase in lubricity between the plug and the metal, the friction coefficient between the material and the tool decreases, and the metal flows to the rear of plug during piercing. As a result of reduction in discard, the material yield increases.

The method of manufacturing a billet for hot extrusion pipe making of the present invention can be employed in finishing piercing to the size of the billet for hot extrusion pipe making. Also, the manufacturing method of the present invention can be employed not only in finishing piercing but also in preliminary piercing performed at an intermediate stage in the case where the hollow billet is finished into the billet for hot extrusion pipe making by a plurality of piercing operations.

EXAMPLES

A billet for hot extrusion pipe making was manufactured by using the upper-end formed glass complex for hot piercing of the present invention as a lubricant and by subjecting a hollow billet to expanding piercing. The material grade of the workpiece and other conditions at the piercing operation are as follows:

Material grade of workpiece (hollow billet): High Cr—Ni alloy (25% Cr-30% Ni)

Billet size and tool size: Refer to Table 1

Upper-end lubricant: $SiO_2$—$Al_2O_3$—$B_2O_3$—CaO based lubricant

TABLE 1

| | Before piercing | Preliminary piercing | Finishing piercing |
|---|---|---|---|
| Billet outside diameter (mm) | 314 | 326 | 330 |
| Billet inside diameter (mm) | 70 | 154 | 206 |
| Billet height (mm) | 768 | 917 | 1120 |
| Container inside diameter (mm) | — | 326 | 330 |
| Plug diameter (mm) | — | 154 | 206 |

After a glass lubricant had been coated onto the outer surface and the inner surface of the billet as the workpiece, the billet was heated to about 1200° C. Thereafter, the billet was inserted into a container, an upper-end lubricant was placed on the upper end of the billet, and subsequently hot piercing (preliminary piercing and finishing piercing) was performed. The upper-end formed glass complex of the present invention was used in the finishing piercing. For comparison, the same hot piercing was performed in the case where a conventional ring-shaped formed glass was used as the upper-end lubricant.

After piercing, operation conditions, quality (billet inner surface flaw), and discard metal weight were evaluated.

The evaluation results of operation conditions are given in Table 2.

TABLE 2

| | Upper-end lubricant | Metallic ring | Automatic supply of upper-end lubricant |
|---|---|---|---|
| Conventional Example | Ring-shaped formed glass | Used | Impossible |
| Inventive Example of the present invention | Upper-end formed glass complex | Not Used | Possible |

As shown in Table 2, in the case where the upper-end formed glass complex of the present invention is used, the metallic ring is unnecessary. Thereby, mounting and demounting the metallic ring in a high-temperature environment are not needed, so that the worker's safety is ensured. Also, in the case where the upper-end formed glass complex of the present invention is used, what is required is only to put the upper-end formed glass complex in place on the upper end of billet. Therefore, this work can be replaced easily with automatic supply using a robot or the like.

The evaluation results of quality (billet inner surface flaw) are summarized in Table 3. In Table 3, the dimensions of major portions of the upper-end formed glass complex of the present invention and the conventional ring-shaped formed glass were shown in addition. The upper-end formed glass complex of the present invention has an outside diameter of 253 mm and an inside diameter of 105 mm. Also, the conventional ring-shaped formed glass has an outside diameter of 205 mm and an inside diameter of 125 mm.

TABLE 3

| | | Dimension of major portions (mm) | | | | | Occurrence rate of inner surface defects | Evaluation |
|---|---|---|---|---|---|---|---|---|
| | | (i) | (ii) | (iii) | (iv) | (v) | (%) | |
| Conventional Example | | — | — | — | 25 | 48.2 | 1.10 | X |
| Inventive Example of the present invention | A | 4.5 | 10 | 3 | 20 | 5 | 0.90 | Δ |
| | B | 4.5 | 3 | 10 | 20 | 5 | 1.00 | Δ |
| | C | 4.5 | 10 | 10 | 20 | 5 | 0.60 | ○ |
| | D | 4.5 | 17.5 | 15 | 20 | 5 | 0.40 | ○ |
| | E | 4.5 | 17.5 | 15 | 15 | 17 | 0.00 | ◎ |

In Table 3, the meanings of symbols in the "evaluation" column are as described below. Herein, the "occurrence rate of inner surface defects" is a rate determined by {(the number of billets on which flaws occurred/the number of billets having been pierced)}×100(%).

◎ : Excellent. Indicating that the occurrence rate of billet inner surface flaw (tool seizure, scratch, etc.) is not more than 0.05%.

○: Good. Indicating that the occurrence rate of billet inner surface flaw is more than 0.05% and not more than 0.60%.

Δ: Fair. Indicating that the occurrence rate of billet inner surface flaw is more than 0.60% and not more than 1.00%.

X: Poor. Indicating that the occurrence rate of billet inner surface flaw is more than 1.00%.

Also, in Table 3, items (i) to (v) in the "dimension of major portions" column correspond to symbols (i) to (v) shown in FIG. 3.

As shown in Table 3, in Conventional Example, the occurrence rate of inner surface flaw resulted from seizure caused by poor lubrication was more than 1%. In Inventive Example of the present invention, however, the flaw occurrence rate was not more than 1.00%. In particular, in Inventive Example of the present invention E (corresponding to the second embodiment), the occurrence of billet inner surface flaw was nil, an excellent result being obtained. Also, in Inventive Examples of the present invention C and D (corresponding to the first embodiment), the occurrence rate of billet inner surface flaw was so low as being not more than 0.60%, ending up in a good result.

The evaluation results of discard metal weight are given in Table 4.

TABLE 4

| | Upper-end lubricant | Discard metal weight (kg) |
|---|---|---|
| Conventional Example | Ring-shaped formed glass | 4.0 |
| Inventive Example of the present invention E | Upper-end formed glass complex | 3.5 |

As shown in Table 4, in the piercing using the formed glass complex of Inventive Example of the present invention E, due to the increase in lubricity between the plug and the metal, the metal flowed to the rear of plug during piercing, and the discard metal decreased significantly as compared with Conventional Example.

INDUSTRIAL APPLICABILITY

The present invention can be used effectively in manufacturing the billet for hot extrusion pipe making using the formed glass.

REFERENCE SIGNS LIST

1: hollow billet, billet for pipe making, 1*a*: guide hole, 2: container, 3: plug, 4: mandrel, 5: upper-end formed glass complex, 6: ring-shaped formed glass part, 7: ring-shaped projecting part, 8: opening, 9: conventional ring-shaped formed glass, 10: metallic ring

What is claimed is:

1. An upper-end formed glass complex for hot expanding piercing, which is used as an upper-end lubricant for a hollow billet by covering the upper end of the hollow billet when the hollow billet inserted in a container is subjected to hot expanding piercing using a plug, wherein the formed glass complex comprises a ring-shaped formed glass part and a ring-shaped projecting part;

the ring-shaped formed glass part assumes a disc shape having a circular opening for allowing a plug to be inserted at the center thereof; and the ring-shaped projecting part is attached to the opening of the ring-shaped formed glass part, and assumes a ring shape projecting perpendicularly to the ring-shaped formed glass part.

2. The upper-end formed glass complex for hot expanding piercing according to claim 1, wherein a thickness of the ring of the ring-shaped projecting part is 5 to 20 mm;

an outside diameter of the ring-shaped projecting part is smaller than an inside diameter of the hollow billet by 1 to 10 mm;

a projection length in a height-wise direction of the ring-shaped projecting part is 5 to 20 mm; and a height of the ring-shaped formed glass part from the billet upper surface is 10 to 35 mm.

3. The upper-end formed glass complex for hot expanding piercing according to claim 2, wherein an upper side of the opening of the ring-shaped formed glass part is beveled; and a bevel angle is 10 to 20° relative to a vertical line.

4. A method of manufacturing a billet for hot extrusion pipe making, wherein when a hollow billet is inserted into a container, and hot expanding piercing is downwardly performed by using a plug, the upper-end formed glass complex for hot expanding piercing described in claim 1 is placed over an upper end of the hollow billet to that it can be used as an upper-end lubricant for the hollow billet.

5. A method of manufacturing a billet for hot extrusion pipe making, wherein when a hollow billet is inserted into a container, and hot expanding piercing is downwardly performed by using a plug, the upper-end formed glass complex for hot expanding piercing described in claim 2 is placed over an upper end of the hollow billet to that it can be used as an upper-end lubricant for the hollow billet.

6. A method of manufacturing a billet for hot extrusion pipe making, wherein when a hollow billet is inserted into a container, and hot expanding piercing is downwardly performed by using a plug, the upper-end formed glass complex for hot expanding piercing described in claim 3 is placed over an upper end of the hollow billet to that it can be used as an upper-end lubricant for the hollow billet.

* * * * *